United States Patent [19]

White

[11] Patent Number: 4,645,585

[45] Date of Patent: Feb. 24, 1987

[54] PRODUCTION OF FUELS, PARTICULARLY JET AND DIESEL FUELS, AND CONSTITUENTS THEREOF

[75] Inventor: Noam White, Balaclava, Australia

[73] Assignee: The Broken Hill Proprietary Company Limited, Melbourne, Australia

[21] Appl. No.: 713,695

[22] Filed: Feb. 27, 1985

[30] Foreign Application Priority Data

Jul. 15, 1983 [AU] Australia ..... PG0301

[51] Int. Cl.[4] ..... C10G 55/04; C10G 55/06; C10C 4/04; C10C 4/06

[52] U.S. Cl. ..... 208/58; 208/15; 208/60; 585/14; 585/25; 585/353; 585/410; 585/425

[58] Field of Search ..... 585/14, 25, 353, 410, 585/425; 208/58, 60, 15

[56] References Cited

U.S. PATENT DOCUMENTS

| | | | |
|---|---|---|---|
| 3,533,938 | 10/1970 | Leas | 208/60 |
| 3,540,999 | 11/1970 | Jacobs | 208/60 |
| 3,544,448 | 12/1970 | Jacobs et al. | 208/60 |
| 3,623,973 | 11/1971 | Tarhan | 208/60 |
| 3,719,586 | 3/1973 | Benner | 208/60 |
| 3,726,788 | 4/1973 | Trythall | 208/60 |
| 3,784,617 | 1/1974 | Suggitt et al. | 585/425 |

*Primary Examiner*—Curtis R. Davis
*Attorney, Agent, or Firm*—Murray and Whisenhunt

[57] ABSTRACT

A first aspect of the invention is concerned with fuels and particularly jet and diesel fuels which comprise blends of substituted mono cyclohexane material and two ring non-fused cyloalkane material. The first material may be n-propylcyclohexane or n-butylcyclohexane. The second material may be nuclear substituted bicyclohexyl and may include cyclohexylbenzene. A second aspect of the invention concerns producing constituents for the fuel from heavy aromatic materials by breaking down the heavy aromatics to naphthas, separating light napthas and other constituents of the fuel before reforming a heavy naptha fraction to provide a BTX fraction which may be treated by hydroalkylation or pyrolysis to provide two ring non-fused cycloalkanes. The product may be enriched by hydrogenation.

18 Claims, 4 Drawing Figures

PRODUCTION OF FUELS, PARTICULARLY JET AND DIESEL FUELS, AND CONSTITUENTS THEREOF

Figure 1:
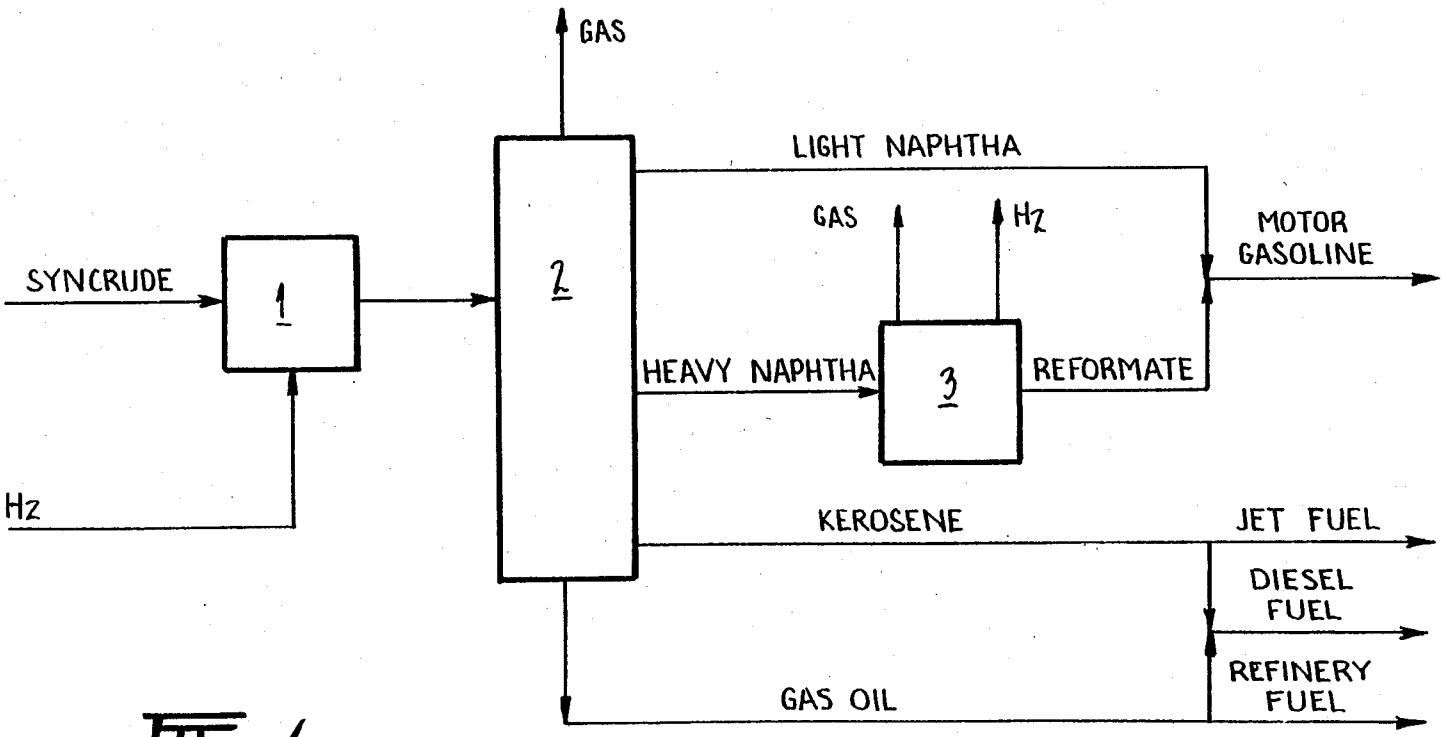

The present invention is related to novel fuel blends and particularly jet or diesel fuel blends, and to a method of producing a range of components of such blends from heavy aromatic compounds. In combination, the invention may accordingly provide a new route for the production of specification grade jet and diesel fuel from highly aromatic heavy oils such as those derived from coal pyrolysis and coal hydrogenation.

The ready availability of crude mineral petroleum has encouraged its establishment as the basis for fuels in engines of various types, but from time to time concern has arisen for the reliability or availability of the supply of petroleum. This concern has stimulated a search for substitutes. Liquids derived from coal, shale and renewable sources such as plant material have been frequently proposed. Since coal consists predominantly of hydrogen and carbon which are the major constituents of petroleum, it is not surprising that the liquefaction of coal has been a leading contender as a substitute for petroleum. The abundance of coal relative to petroleum and more extensive distribution across the globe have added stimulus to the development of coal liquefaction.

A very considerable body of literature, expertise and technology has been accumulating in the area of coal liquefaction. The objectives of coal liquefaction are manifold. Coal may be converted to a liquid as a means by which the mineral matter and other undesirable materials are removed leaving essentially an organic material which could be used as a "clean" boiler fuel. Alternatively the "clean" coal could find use as a pitch substitute, and applications such as a binder or as a precursor for the production of cokes and graphites. Such processes invariably require a solvent extraction or solvent refining of the coal.

The pyrolysis of coal in various ways, be it by slow coking, charring or rapid flash heating in the presence of a controlled atmosphere (e.g. pyrolysis in the presence of hydrogen - hydropyrolysis), will produce coal tars and oils of differing quality depending on the conditions employed. These tars and oils could be used as petrochemical feedstocks or as feedstocks for refining into transport fuels which are hereby defined as gasoline, jet fuel and automotive diesel. The current state of the art advocates, in broad terms the fractionation of oil for use as fuels into three major boiling fractions corresponding to a naphtha (destined for gasoline) kerosene (destined for jet fuel) and distillate (destined for automotive diesel). The kerosene and distillate fractions are hydrogenated to convert them to their respective specification grade fuels.

One of the major difficulties with the pyrolysis processes is that a considerable proportion of the coal is converted to coke or char which must be disposed of and rarely does the proportion of coal converted to tar or oil exceed 20% by weight of the original coal matter expressed on a dry and ash free basis.

Two other processes have therefore been investigated which are claimed to convert a greater proportion of the coal to liquid-like products. These are the so called Fischer-Tropsch synthesis, and the hydrogenation or Bergius-Pier process. In the former the coal is gasified and converted to synthesis gas, a mixture of carbon monoxide and hydrogen. The synthesis gas is introduced into a reactor containing a catalyst which results in the production inter-alia of hydrocarbons ranging from light gases to heavy waxes. Reactors in which the catalyst is fluidized (e.g. Kellog design) produce the light gases whereas reactors containing a fixed catalyst bed (e.g. Arge) tend to produce the heavier materials.

While the Fischer-Tropsch process has been commercialized it is considered to be a process of relatively poor thermal efficiency. The conversion of the coal to synthesis gas is a high temperature process (700°–1000° C.) for which the recovery of heat must be traded off against costly heat exchange equipment. The conversion of the synthesis gas to hydrocarbons or similar products is a relatively low temperature process (about 300° C.) but the reaction is very exothermic. The selectivity of the reaction towards hydrocarbons is not perfect and some oxygenated products such as alcohols, ketones and acids are produced. These can be recovered and sold as chemicals but if markets are not available for these products further processing is required to convert them to suitable fuel blend stocks.

Though not a process having all the desirable features that may be wished for, the Fischer-Tropsch route can be selected so as to produce the full range of transport fuels. Kerosene can be produced which will meet most standards for jet fuels and a distillate fraction can be made which will make an acceptable automotive diesel. The naphtha fraction is relatively poor in quality for use as gasoline, generally having a low octane number, but this need not be a major obstacle because many reforming processes are now available which are capable of upgrading low octane number naphthas into high octane number material suitable for blending into gasolines.

The reasons generally attributed to the poor quality naphtha fraction is that the Fischer-Tropsch process inherently produces a naphtha containing lower olefinic and paraffinic hydrocarbons. The olefins are readily converted to paraffins by mild hydrotreating.

As will be discussed below, paraffins, particularly linear paraffins are ideal compounds for jet fuel and diesel applications. They are low octane number hydrocarbons and the reforming process converts the paraffins into branched paraffins, cyclic compounds and aromatics all of which generally possess high octane number for use in gasolines.

The "cleanliness" of the Fischer-Tropsch product is generally very good. By "cleanliness" is generally meant the absence of nitrogen, sulphur and oxygen compounds in the product. Though the Fischer-Tropsch product is generally free of sulphur and nitrogen, as noted above contamination by oxygenates may call for extra processing of the product prior to sale. Sometimes the tars produced from the gasification of the coal are treated and blended into various products and these may contain high levels of the nitrogen, sulphur and oxygen compounds.

The second major class of processes for liquefying coal previously identified is based on the hydrogenation of coal. It is presently thought that most of the aforementioned solvent extraction routes proceed through a hydrogenation mechanism. Essentially in the hydrogenation process, coal is mixed with an oil variously referred to as the solvent, slurrying agent, vehicle and donor solvent, and the slurry so formed is reacted at pressures between 10–30 MPa and temperatures between 350°–500° C. for periods as long as 4 hours but generally about an hour. Hydrogen is added in most processes, together with, sometimes, a catalyst. Other materials from the downstream processing may be recycled and added. For example recycling of the mineral matter from the liquefied coal is sometimes considered beneficial to the conversion of the coal.

The source of the solvent oil may be totally external, that is from sources other than the coal being processed. It may be a coal tar from some other process, a residue or fraction from mineral petroleum processing or similar fractions from shale oil or tar-sands oil. Alternatively the oil may be derived from the liquefaction process itself. Thus a fraction of oil may be distilled from the product of the reactor and recycled. Sometimes combinations of the external and internal oils are used and in some processes the oil may be treated to improve its hydrogen donor or solvation properties.

The hydrogenation of coal can be understood in chemical terms by regarding the coal as a hydrogen and carbon compound $CH_{0.8}$. Most heavy oils will have an approximate formula of $CH_{1.8}$. Thus by absorbing hydrogen the coal converts to a heavy oil. The heavy oil can then be treated by a variety of processes to form light oil from which transport fuels might be produced.

The coal will contain nitrogen, sulphur and oxygen and some reduction in the level of these undesirable elements does occur during liquefaction. Notwithstanding this reduction the heavy oil will still contain levels of these elements which will generally make the oil unacceptable for direct combustion because of the emission of excessive levels of nitrogen and sulphur oxides. Furthermore oils of this quality are not acceptable for some types of secondary processing steps because the N, S, O content may poison certain types of catalysts. For example cracking catalysts are poisoned by high nitrogen content feedstocks.

Therefore it is sometimes necessary to subject the heavy coal-derived oil to some type of hydroprocessing such as hydrotreating to reduce the N, S & O to more acceptable levels. This requires further hydrogen to be added to the oil. Thus hydrogen is required to hydrogenate the coal to heavy oil and further hydrogen is required to render the heavy oil amenable to further treatment or utilization. The hydrogen requirements of coal hydrogenation are produced by first gasifying the coal to synthesis gas and "steam shifting" the carbon monoxide to hydrogen as is well known to those skilled in the art. However the proportion of coal that needs to be gasified is clearly a moderate proportion of the coal fed to the overall process and therefore the overall thermal efficiency is much greater than in the Fischer-Tropsch process.

Whilst the hydrogenation of the coal and the upgrading of the coal oil are exothermic processes they are not as exothermic as the Fischer-Tropsch reactions.

It is for this reason that much attention has been given to the perfection of coal hydrogenation processes. Whilst it can be claimed that the Fischer-Tropsch process is not sensitive to coal properties, since gasification is not as demanding as hydrogenation in this respect, coals suitable for hydrogenation have been discovered in most of the world's coal producing countries. However one of the problems associated with coal hydrogenation lies in the fact that oils so produced tend to be predominantly aromatic. There are exceptions to this which appear to relate to the coal type; for example very low rank coals such as brown coals and peat will produce liquids rich in saturated hydrocarbons. It should further be made clear that many of the characteristics of coal hydrogenation liquids are shared by liquids from coal pyrolysis, some shale oils and aromatic liquids derived from the conversion of oxygenates and hydrocarbons over zeolite catalysts where such feedstocks can be derived from carbonaceous sources such as coal. Aromatic naphthas make good gasolines but the aromatic kerosenes produced by the above methods are too "smoky" for commercial jet fuel applications and aromatic distillates produced by the above methods have cetane numbers that are too low to make good diesel fuels.

Aviation fuels are graded under many specifications. One of these is ASTM D1655-82 which defines specific types of aviation turbine fuel for civil use. It does not include all fuels satisfactory for aviation turbine engines. Certain conditions or equipment may permit a wider, or require a narrower, range of characteristics than stipulated by the above specification, which defines three types of aviation turbine fuels, Jet A, Jet A1 and Jet B. Jet B is a relatively wide boiling range volatile distillate whereas Jet A and Jet A1 are relatively high flash point distillates of the kerosine type which differ in freezing point. There are similar divisions for diesel fuels essentially depending upon the performance requirements of the engine as set out for example in ASTM D975-81.

A brief summary of how transport fuels may be blended up from different hydrocarbon boiling range fractions and the primary property requirements used in many countries are summarized in Table 1.

TABLE 1

| FUEL | PREDOMINANT[5] FRACTION | BOILING[4] RANGE | PRIMARY QUALITY REQUIREMENTS |
|---|---|---|---|
| Gasoline | Naphtha | $C_5$–200° C. | RON[1] |
| Jet-Fuel | Kerosene | 200°–250° C. | Smoke Point 20[2] mm |
| Automotive-Diesel | Distillate | 250°–300° C. | Cetane Number 40[3] |

Notes on Table 1:
[1]Gasoline research octane number (RON), as measured by test ASTM D2699-79, will vary according to standard or super grades. If the raw naphthas from which the gasoline is produced has a RON exceeding 80 only light processing is generally required.
[2]Smoke Point as measured by test IP54/55 (1975). Different specifications prevail from country to country and it is to be noted that military jet fuels tend not to have to meet smoke point requirements.
[3]Cetane number as measured by test ASTM D613-79. Frequently estimated from the Diesel Index IP21/53 (1975) or the Cetane Index ASTM D976.
[4]Boiling ranges are arbitrary.
[5]Fractions are arbitrary. Some kerosene may be incorporated into automotive diesel.

For coal hydrogenation liquids to be converted to transport fuels they have had to be subjected to extensive hydroprocessing. It has been considered that the aromatic nature of coal hydrogenation liquids militates against their use as a source of diesel fuels (see for example H. C. Hardenburg "Thoughts on an ideal diesel fuel from coal", The South African Mechanical Engineer, Vol. 30 page 46, February 1980 and D. T. Wade et al "Coal Liquefaction", Chem. Tech. page 242, April, 1982) but to illustrate one approach to the upgrading of coal hydrogenation liquids into specification grade diesel and jet fuel reference is made to the results of Sullivan et al in "Refining and Upgrading of Synfuels from Coal and Oil Shales by Advanced Catalytic Processes" Chevron Research Co which were obtained under DOE Contract No. AC22-76ET 10532, September, 1981.

Sullivan et al took liquids from two coal hydrogenation processes, SRCII and H-Coal and subjected them to three basic modes of processing. Only two of those modes are relevant here, namely the so-called Jet-Fuel Mode illustrated in FIG. 1, and the All-Gasoline-Mode illustrated in FIG. 2. Both the Jet-Fuel Mode and the All-gasoline Mode use Syncrude which is a highly aromatic heavy oil that could be obtained from coal hydrogenation, coal pyrolysis, coal gasification tar, heavy shale oil or other carbonaceous feedstock processes.

In the Jet-Fuel Mode of FIG. 1, the syncrude is subjected to hydrotreating in unit 1 to cleanse the oil and stabilize reactive components. The product of the hydrotreatment enters a distillation column 2 where the light gases are removed and a light naphtha portion is taken off for blending into gasoline. The column 2 also has take off points for heavy naphtha which passes through a reformer 3 to produce a BTX (benzene, xylene and toluene) rich liquid which is blended with the light naptha; and for kerosene and gas oil which may be respectively suitable for jet and refinery fuels and may be blended to produce a diesel fuel.

Figure 2:
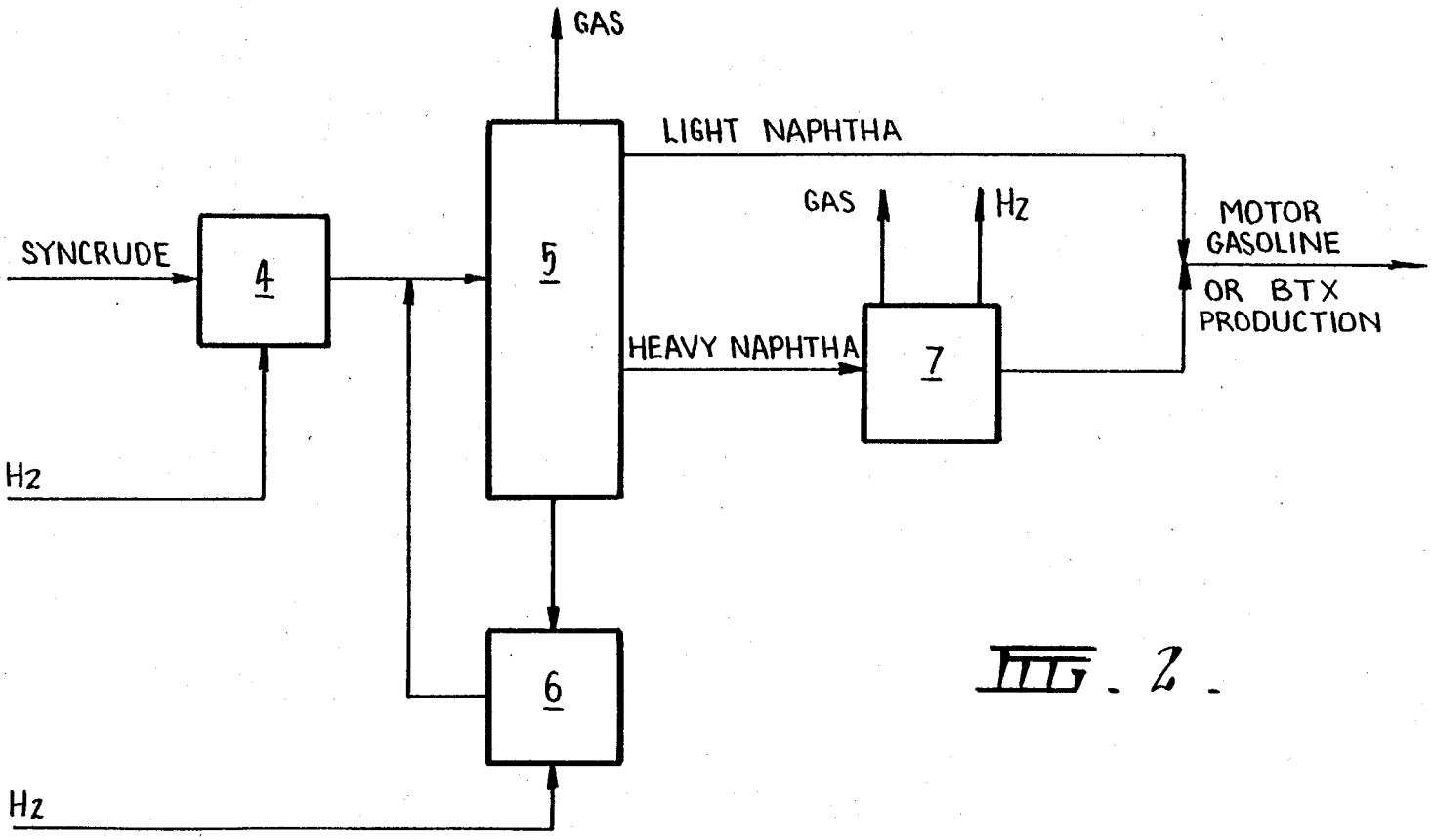

In the All-gasoline Mode of FIG. 2 the syncrude is subjected to hydrotreating in unit 4 to cleanse the oil and stabilize reactive components. The product of the hydrotreatment enters a distillation column 5 together with the product of a recycle hydrocarbon 6 which treats non-distilled products of the distillation column. Light gases are removed from the column 5 and a light naphtha portion is taken from the column for blending purposes. A heavy naphtha fraction is also drawn off the column and passes to a reformer 7 to produce a BTX rich liquid which may be blended with the light naphtha fraction to provide gasoline.

The following major conclusions can be drawn from these two modes:

1. Specification grade diesel and jet fuels and gasoline were made from the coal liquid using conditions within the bounds of commercial operation of hydroprocessing.
2. The cetane number was the limiting specification for diesel fuel and smoke point was the limiting specification for jet fuel. That is, when these specifications were met all other specifications were met (with the exception of some minor specifications such as specific gravity) but the reverse was not found to be the case.
3. The Jet Fuel Mode of operation required more severe conditions of operation than the All Gasoline Mode and consumed more hydrogen.

As a result of conclusion 2, Table 1 was formulated to recognize cetane number and smoke point as the primary property requirement for diesel fuel and jet fuel respectively, although it should be made clear that military jet fuels are not generally required to meet smoke point requirements. It may also be inferred that the All Gasoline Mode, results in cheaper processing than the Jet Fuel Mode. Even though the latter mode employs one reactor 1 it is required to operate at a space velocity of 0.5 LHSV whereas in the All Gasoline Mode the two reactors 4 and 6 operate at unity or greater than unity space velocity, and with less severe operating conditions.

Another interesting feature emerging from the work of Sullivan et al was that the aromatic content of the diesels from the coal liquids had to be reduced to below 4% LV before the cetane number specification was met and the same aromatic removal had to be achieved with jet fuels before they met the smoke point specification. It is well known that diesel and jet fuels derived from petroleum oils can contain considerably higher levels of aromatics than 4% and still meet the specifications. Thus, the "Jet A" specification D1655-78 permits aromatics to run as high as 20% LV.

The reason for Sullivan et al having to reduce the aromatic content of the fuels to below 4% LV may be considered to be due to the starting coal-derived liquids in their study being high in aromatic and naphthene content. The paraffin content was rarely greater than 10%. Those knowledgeable in this field will know that these values are as expected for coal derived liquids. When the aromatics are hydrotreated they are converted to naphthenes which according to the study of Hardenberg (supra) are still considerably inferior in cetane number to linear paraffins. Similarly naphthenes do not have as high a smoke point as the corresponding linear paraffins. Diesels and jet fuels made from the majority of petroleum oils are rich in linear paraffins and can therefore tolerate higher levels of aromatics. As will be appreciated hereinafter the nature of the aromatics is also an important factor, as is the nature of the naphthenes. Ideally then one would wish to use processes which can readily convert aromatics into linear paraffins, but no such processes have been discovered as yet.

Therefore in order to make specification jet fuel and diesel from aromatic liquids such as those from coal hydrogenation one must seek to maximize the production of naphthenic materials. Such a process is described in U.S. Pat. No. 4,332,666, in which a portion of the liquid from a coal hydrogenation process drawn from the distillate or solvent fraction boiling range 170° C. (350° F.) to 275° C. (525° F.), is subjected to a catalytic hydrogenation process. The aromatic and hydroaromatic constituents are extracted with a solvent, sulfolane, leaving a naphthenic fraction which meets the requirements of the "Jet-A" specifications. The aromatics and hydroaromatics are separated from the sulfolane and are recycled as a component of the hydrogenation solvent in the coal liquefaction operation. Thus not only is a useful product made but the recycle solvent is improved because of the saturates removal and hydroaromatic enhancement.

The jet fuel produced by this method is reported to contain about 15% aromatics and this probably stems from the fact that the solvent does not extract the paraffins and naphthenes. However in the hydrotreating situation such as in the work of Sullivan et al. it may well be the case that a portion of the paraffins is degraded to light material.

In summary, therefore, while the pyrolysis or hydrogenation of coal produces the three boiling fractions of oil corresponding to naphtha, kerosene and distillate, it does so in a relatively inefficient manner. As an alternative, the Fischer-Tropsch process produces acceptable kerosene and distillate fractions but low quality naphthas since the product consists essentially of lower olefinic and paraffinic hydrocarbons. Additionally the Fischer-Tropsch process is not considered to be thermally efficient. The further alternative of hydrogenating the coal produces predominantly aromatic oils which, while eminently acceptable as naphthas, have not been considered satisfactory in the kerosene and distillate fractions, and processes such as those proposed by Sullivan et al and by U.S. Pat. No. 4,332,666 have been used to reduce the aromatics content.

It has now been found that contrary to all the aforesaid previous investigations which have called for low levels of aromatics in jet and diesel fuels, blends of certain compounds derivable from aromatic compounds together with selected aromatics may produce very acceptable jet and diesel fuels. Such fuels may or may not meet all the specification requirements of jet and diesel fuels, for example a jet fuel may not meet commercial smoke point requirements but still be usable as a military jet fuel. Equally other blends of the fuel may be eminently suitable as a heating fuel.

Thus, according to a first aspect of the present invention there is provided a fuel which comprises a blend of substituted mono cyclohexanes and two-ring non-fused cycloalkanes.

It has been found that blends of these two groups of compounds may be made with or without additions of other aromatic compounds, to meet at least the majority of the commercial specifications for diesel and jet fuels.

The substituted mono cyclohexane is preferably selected from one or more of n-propylcyclohexane and n-butylcyclohexane while the non-fused cycloalkane is advantageously nuclear substituted bicyclohexyl but may include nuclear substituted cyclohexylbenzene. Whereas conventional thinking has been that specification grade diesel and jet fuels can only be provided by a substantial proportion of long-chain alkanes, we have found that the substituted mono cyclohexanes, specifically n-propylcyclohexane and n-butylcyclohexane, have very high smoke points, relatively high cetane numbers (as inferred from the reciprocity relationship between octane number and cetane number) and low freezing points. In combination, in suitable proportions, with nuclear substituted (i.e. non-fused) cycloalkanes of which specifically bicyclohexyl has a high boiling point, high cetane number and high smoke point, the substituted mono cyclohexanes provide remarkably good diesel and jet fuels.

Other compounds derivable from aromatic compounds together with selected aromatics may be included in the fuel to enhance certain properties, for example hydrindane has a high smoke point, relatively high inferred cetane number and a low freezing point while decalin may be used a blending agent for its low freezing point characteristic notwithstanding that it has an inferior cetane number and smoke point to bicyclohexyl. Up to approximately 10% biphenyl may be included in the fuel and is particularly desirable in military jet fuels for its heat sink properties.

TABLE 2

| NO | COMPOUND | BOILING POINT °C. | FREEZING POINT °C. | OCTANE RON | CETANE NO | CETANE NO (RECIPROC.) | ANILINE CLOUD POINT °C. | SMOKE POINT MM | DENSITY g/mL 20° C. |
|---|---|---|---|---|---|---|---|---|---|
| I | N—PROPYLCYCLOHEXANE | 157 | −95 | 17.8 | | 45[2] | 50 | 45[3] | 0.794 |
| II | HYDRINDANE[8] | 162 | −22[3] | — | | | — | 23[3] | 0.862 |
| III | N—BUTYLCYCLOHEXANE | 181 | −75 | <10 | | 50[2] | 54 | 50[3] | 0.799 |
| IV | DECALIN[7(1)] (CIS) | 196 | −42 | 32[3] | | 40[2] | 35 | 22[3] | 0.897 |
| | (TRANS) | 187 | −30 | | | | 35 | | 0.870 |
| V | TETRALIN[7(2)] | 207 | −35 | 96 | | 15 | <−20[3] | 6[3] | 0.969 |
| VI | NAPHTHALENE | 218 | 80 | | | | <<−20 | | 1.025 |
| VII | BICYCLOHEXYL[6(1)] | 238 | 4 | | 53[1] | | 48[3] | 30[3] | 0.891/ 0859[5] |
| VIII | CYCLOHEXYLBENZENE[6(3)] | 235 | 7 | | — | | <−10[3] | | 0.950 |
| IX | BIPHENYL[6(2)] | 256 | 70 | | 21[1] (47 at 25%) | | — | | 0.866 |

REFERENCES TO TABLE 2: MOST DATA ASTM DATA SERIES DS4A (1)SPIERS, H. M. (ed.), "Technical Data on Fuel" 6th Edition, The British National Committee, World Power Conference, Page 284 (1961)

(2)Estimated from reciprocity between octane number and cetane number as shown in GOODGER, E. M. "Hydorcarbon Fuels - Production Properties and Performance of Liquids and Gases", MacMillan Press Ltd. London 1975

(3)As Measured.

(4)Handbook of Physics and Chemistry 52nd Edition.

(5)Cis-Cis, and Trans - Trans Isomers.

(6)ALTERNATIVE COMPOUND NAMES

1. Bicyclohexyl, Dicyclohexyl, Dodecahdrobiphenyl.
2. Biphenyl, Diphenyl, Phenylbenzene
3. Cyclohexylbenzene Cyclohexyl Phenyl, Cyclohexanephenyl, Benzene-cyclohexyl, 1,2,3,4,5, Hexahydrobiphenyl, Phenylcyclohexyl (7)ALTERNATIVE COMPOUND NAMES 1. Decalin, Decahydronaphthalene
2. Tetralin, Tetrahydronaphthalene (8)ALTERNATIVE COMPOUND NAMES 1. Hydrindane, Hexahydroindane, Octahydroindene The fuel of the present invention may be further understood is terms of the data presented in Table 2. The majority of the compounds listed may be present in coal hydrogenation products, although not necessarily in large quantities, but have been fractionated out of the kersoene and distillate portions of the heavy oil. Of compounds VII to IX in Table 2, biphenyl is said to be produced by mechanisms involving the ring opening of 3 fused ring aromatic structures such as phenanthrene (W. L. Wu and H. W. Haynes Jr "Hydrocracking Condensed—Ring Aromatics Over Non-Acidic Catalysts", page 65 in the American Chemical Society Symposium Series No. 20, 1975). Despite the abundance of such precursors, biphenyl is reported as only encountered in coal-derived liquids in quantities rarely greater than a few percent (S. E. Scheppele, G. J. Greenwood, R. J. Pancirov and T. R. Ashe "Chemical Composition of Raw and Upgraded Anthracene Oil and the Chemistry of Coal Liquids Upgrading", page 39 in American Chemical Society Symposium Series 156, 1981). Equally cyclohexylbenzene and bicyclohexyl have not been reported in coal derived liquids in any significant quantities. Yet it is clear from Table 2 that these three components have properties which make them very desirable for blending with substituted mono cyclohexanes into diesel and jet fuels.

The cetane number of cyclohexylbenzene has not been measured, but it is reasonable to infer that its properties in this respect are likely to be intermediate those of biphenyl and bicyclohexyl. In relation to the behaviour of these non-fused double ring compounds as jet fuels, reference can be found to their properties in this respect as potential military jet fuels for Mach 6 to Mach 7 military jet systems. In this application not only is fuel expected to meet the military jet fuel specification but also to offer "heat sink" cooling by dehydrogenation. (See A. W. Ritchie and A. C. Nixon "Dehydrogenation of Dicyclohexyl over a Platinium-Aluminia Catalyst without Added Hydrogen", Industrial Engineering Chemistry Product Research Development 9 (2) page 213, 1970).

Propyl and butyl cyclohexane, as well as hydrindane have been found to be present in fairly sizeable proportions in coal-derived naphthas, as will be shown hereafter in Example 1. Furthermore the precursors of these compounds are tetralins and indans which are found in abundance in coal derived liquids because these compounds are in turn readily produced from multi-fused ring aromatics from naphthalene onwards.

The aforementioned U.S. Pat. No. 4,332,666 in effect recommends the hydrogenation of fused ring aromatic mixtures to produce a liquid rich in the saturated homologues of tetralins and indans. But it is clear from Table 2 that a fused ring naphthene represented by decalin has an inferior cetane number and smoke point to the non-fused ring binaphthene as represented by bicyclohexyl. As previously indicated, however, decalin does have a superior freezing point characteristic, and so may advantageously be blended with the fuel.

In summary, if access is available to the compounds listed,in Table 2, and particularly to compounds I, III, VII and VIII in the Table, they may be blended in accordance with the first aspect of the present invention to produce a fuel and in particular specification grade jet and diesel fuels. It is an object of the second aspect of the present invention to produce bicyclohexyl, cyclohexylbenzene and bicyclohexyl components from a compound such as a coal-derived liquid.

According to the second aspect of the invention there is provided a method of producing two-ring non-fused cycloalkane compounds from heavy aromatic compounds which comprises converting the heavy aromatic compounds into single carbon ring compounds and rebuilding at least some of said single carbon ring compounds into bi-cyclic nuclear substituted cycloalkanes.

By the second aspect of the present invention, rather than the heavy aromatic compounds being saturated to greater than 95% conversion to produce a marginally satisfactory range of compounds for jet and diesel fuel as in conventional processes, the heavy aromatics may be reformed to, preferably, single six-carbon ring compounds and subsequently rebuilt in the desired format to produce bi-cyclic nuclear substituted cyclohexanes which either directly or with some further processing have been found in accordance with the first aspect of the present invention to be eminently suitable as blending agents for jet and diesel fuels.

According to a preferred embodiment of the second aspect of the present invention all or substantially all the heavy oil is converted to naphtha by a combination of hydrotreating/hydrocracking. Selected naphtha components are removed and the remaining naphtha reformed to produce a BTX (benzene, toluene and xylene) fraction. The BTX fraction is subjected to a process (e.g. a combination of hydroalkylation and hydrogenation) to produce non-fused bicyclic compounds such as biphenyl, bicyclohexyl and cyclohexylbenzene, which when blended with the selected naphtha components in the appropriate proportions in accordance with the first aspect of the present invention can yield specification jet fuel and diesel.

The production of single benzene ring compounds from heavy aromatic compounds has been discussed hereinbefore with reference to Sullivan et al and the conversion of a primary coal hydrogenation product, and will be further discussed, in a non-limiting manner, with continued reference to the work of Sullivan et al.

By converting all or substantially all of the primary coal hydrogenation product into naphtha, for example by a combination of hydrotreating/hydrocracking, it is possible to achieve the technical and economic advantages cited by Sullivan et al over processing through the jet fuel mode. The naphtha may then be relatively free of oxygen, nitrogen and sulphur compounds and lend itself to further processing through a variety of steps involving special catalysts to be described below. In breaking down the hydrogenation product there will normally be a residue of two or more carbon ring compounds. Advantageously for further processing the naphtha should have a maximum boiling point not greatly exceeding 200° C. Accordingly, naphthalene and tetralins, for example, may therefore be returned to the conversion apparatus, such as a hydrocracker, but lower boiling multi-ring compounds, such as decalins, may be retained in the naphtha.

The naphtha may contain other desirable compounds, including at least some of those listed in Table 2, and it is well known that in order to separate out such desirable compounds from a naphtha, simple distillation is generally the most economical and effective method in view of its relatively low boiling point. In contrast, the higher the boiling point of a complex hydrocarbon mixture, the greater the number of homologues possible and the less reliable distillation is as a means of separation. Furthermore in order to avoid cracking of the compounds of interest at higher boiling point it may be necessary to employ vacuum distillation, and, because it is not possible to achieve a high separation efficiency (that is a large number of theoretical plates or stages) under vacuum conditions, separation by distillation becomes unreliable. It is generally considered that about 200° C. is the upper limit for successful component separation by distillation at atmosphere pressure. Nevertheless whilst distillation is the preferred mode of separating the compounds of interest, other means of separating, such as solvent extraction are not precluded. Thus, the drawback of having to use solvent extraction methods inherent in U.S. Pat. No. 4,332,666 may be avoided.

Having produced a naphtha with components which are to be separated for either subsequent blending or processing, the remaining naphtha can then be subjected to reforming to bring it up to specification for premium grade gasoline or for BTX/petrochemical applications. Prior to reforming the remaining naphtha, any decalins present may be removed because on reforming they will be converted to naphthalene which is an undesirable gasoline component as well as causing operational problems in the reformer. The removed decalins will remain in a second heaviest distillation cut and may be retained for use as a blendstock for jet and diesel fuel as discussed hereinbefore.

Moving down the boiling range scale, any butyl cyclohexane in the naphtha is removed and retained. Next a stream containing any indan and hydrindane is removed and the indan and possibly the hydrindane returned to, for example, the hydrocracker to increase the yield of substituted cyclohexanes and hydrindane. Propyl cyclohexane may then be removed and retained. The final fraction removed is one rich in cyclohexane and benzene which may also contain some of their substituted homologues. In some cases however this fraction is not separated and this is discussed below.

The relatively large remaining fraction may now be subjected to a variety of possible processes to dimerize cyclohexane to bicyclohexyl and benzene to biphenyl and the production of cyclohexyl benzene by the hydroalkylation of benzene with cyclohexane.

The production of compounds VII to IX in Table 2 using cyclohexane and benzene from coal-derived naphthas is particularly important bearing in mind the discovery in accordance with the first aspect of the present invention that other compounds also present in the naphthas neatly complement the properties of said compounds VII to IX to make the formulation to specification of jet and diesel fuels possible. These lighter compounds are considered to offer front-end volatility without compromising flash-point, as well as high smoke point and high cetane number properties.

The production of biphenyl in particular has received considerable attention because of its extensive use as a component in heat transfer fluids. Having produced biphenyl, of which only up to about 10% may be present in the fuel of the first aspect of the invention, some or all of it may be hydrogenated to produce bicyclohexyl or cyclohexylbenzene using reasonably standard operating conditions. (See for example A. V. Sapre and B. C. Gates, "Hydrogenation of Aromatic Hydrocarbons Catalysed by Sulfided $CoMoO_3/Y\text{-}Al_2O_3$. Reactivities and Reaction Networks" Industrial Engineering Chemistry Process Design and Development 20 page 68 1981).

It is also possible to produce cyclohexylbenzene by alkylation of benzene with cyclohexane in the presence of alcohols and a Friedels-Crafts catalyst. (See, C. Ndandji, L. Tsuchiya - Aikawa, R. Gallo and J. Metger "Unconventional Friedel - Crafts Alkylation of Benzene with Cycloalkanes Activated by Alcohols" Nouveau Journal De Chimie 6 (3) page 137, 1982). Bicyclohexyl can be produced by the irradiation of cyclohexane in liquid ammonia but cyclohexylamine is produced as a by-product (V. I. Stenberg and C. H. Niu "Nitrogen Photochemistry VII" Tetrahedron Letters 49 page 4351, 1970). Both of the aforementioned processes are cited as examples and are not intended to limit the scope of the invention.

The most satisfactory way to produce the desired proportions of compounds VII to IX in Table 2 is to maximize biphenyl production, and hydrogenate the biphenyl as described. This represents the preferred embodiment of the process. When this approach is adopted the benzene and cyclohexane fractions need not be separated from the naphtha. The naphtha may be reformed as shown in Sullivan et al All Gasoline Mode of FIG. 2. The reformer converts most of the naphthenes to aromatics and from the reformed naphtha it is possible to readily isolate a stream rich in single ring aromatics (e.g. the benzene toluenes and xylene stream known as the BTX fraction).

Many processes are available for the conversion of monoaromatics to biphenyl and in listing some of them by way of example it is not intended to limit the scope of this invention. A number of terms, such as "dehydrogenative coupling", "oxidative dimerization", "dehydrocondensation", dehydrodimerization" and "hydroalkylation", are given to the step by which monoaromatics are converted to biphenyls.

Biphenyl can be produced by the pyrolysis of benzene when the latter is passed through a red-hot iron tube, bubbled through molten lead or pumice or passed at elevated temperatures over vanadium compounds. ("Kirk-Othmer, Encyclopedia of Chemical Technology" 3rd Edition Volume 12 page 748). Japanese patent publication 7238955 teaches the preparation of biphenyl from benzene over lead oxide. U.S. Pat. No. 3,359,340 shows how the selectivity and conversion of benzene to biphenyl in the pyrolysis process can be improved by additions of benzoic acid.

Another class of processes is exemplified by U.S. Pat. No. 3,274,277 in which benzene is reacted with ethylene over a catalyst consisting of sodium dispersed on an alumina support at reaction temperatures of from about 130° C. to about 165° C. Since ethylene is a possible by-product of coal hydrogenation, this process could be usefully employed in the present invention when the benzene rings are obtained by way of the hydrogenation of coal.

The next class of processes for the production of biphenyls involve coupling agents such as Grignard reagents (Kirk-Othmer, volume 12 page 39) and palladium salts (for example U.S. Pat. Nos.: 3,401,207, 3,728,409 and 3,748,350). By far the most useful processes in this context are those closely resembling petroleum refining and conventional petrochemical processes. An example of a process in this category is described in U.S. Pat. No. 3,962,362 in which benzene is mixed with a recycle stream of cyclohexyl benzenes and hydrogen and passed over a hydroalkylation catalyst. This consists of 23% cobalt on rare-earth ammonium exchanged faujasite-type cracking catalyst which is calcined and pre-reduced in hydrogen. The primary product is a cyclohexylbenzene mixture which is described in the U.S. patent as then being sent on to a dehydrogenation unit to produce biphenyl. In contrast, for the purposes of the present invention this technology can be applied by taking the cyclohexylbenzene mixture and hydrogenating to bicyclohexyl.

U.S. Pat. No. 4,093,671 discloses a process employing a hydroalkylation catalyst with a composition comprising at least one platinum compound supported on a calcined acidic, nickel and rare-earth treated crystalline zeolite of the Type X or Type Y family. Cyclohexylbenzene is produced with high selectivity and overall conversion from benzene by this process.

Thus it is shown that compounds VII to IX of Table 2 may be produced from monoaromatics-rich naphtha derived from coal hydrogenation liquids (or similar liquids) which have been subjected to a hydrotreating and hydrocracking step followed by reforming the monoaromatic fraction so produced, such naphtha being relatively free of the sulphur, nitrogen and oxygen compounds which would poison catalysts of the type described in U.S. Pat. Nos. 3,962,362 and 4,093,671.

Figure 3:
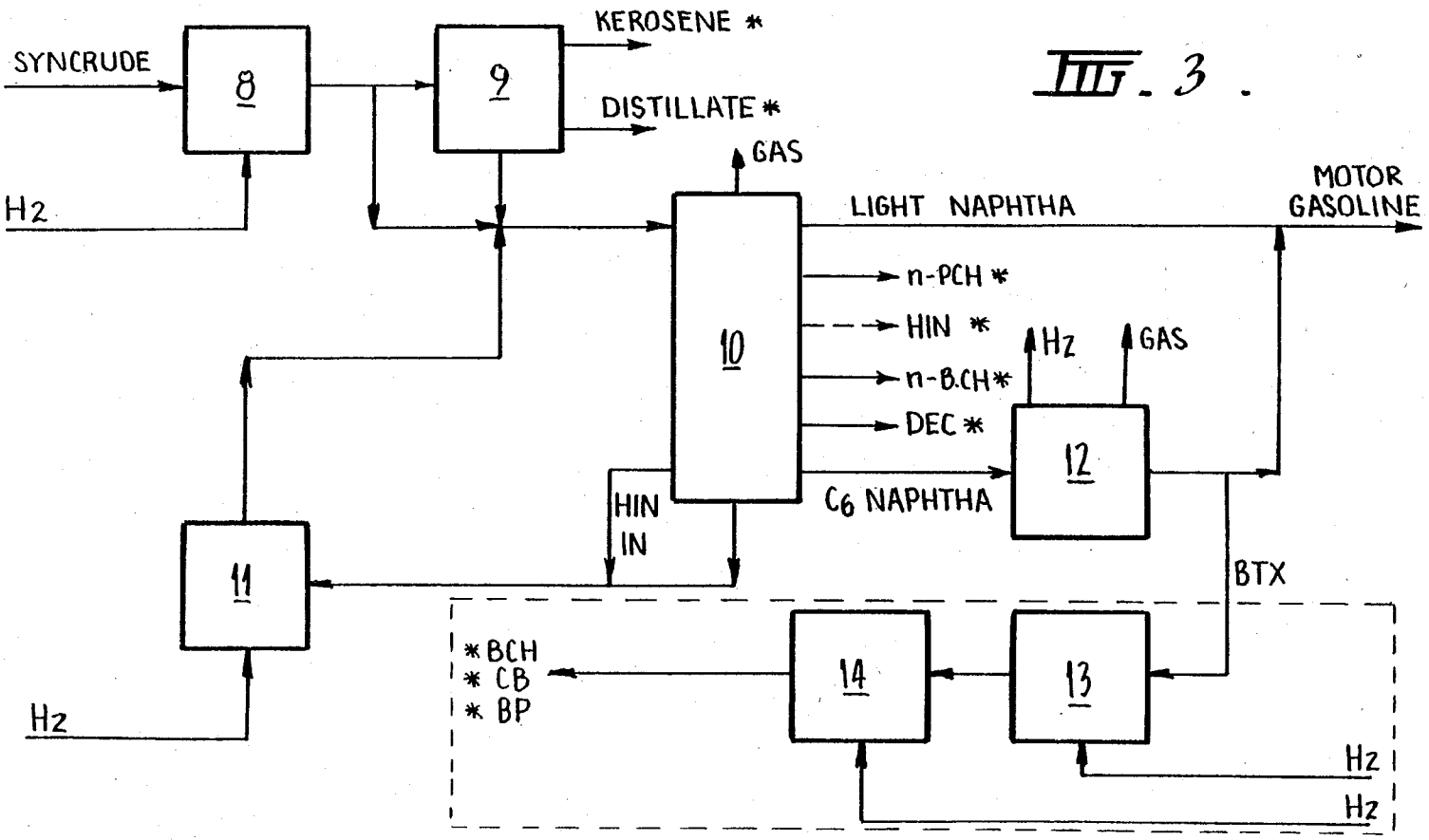
Figure 4:
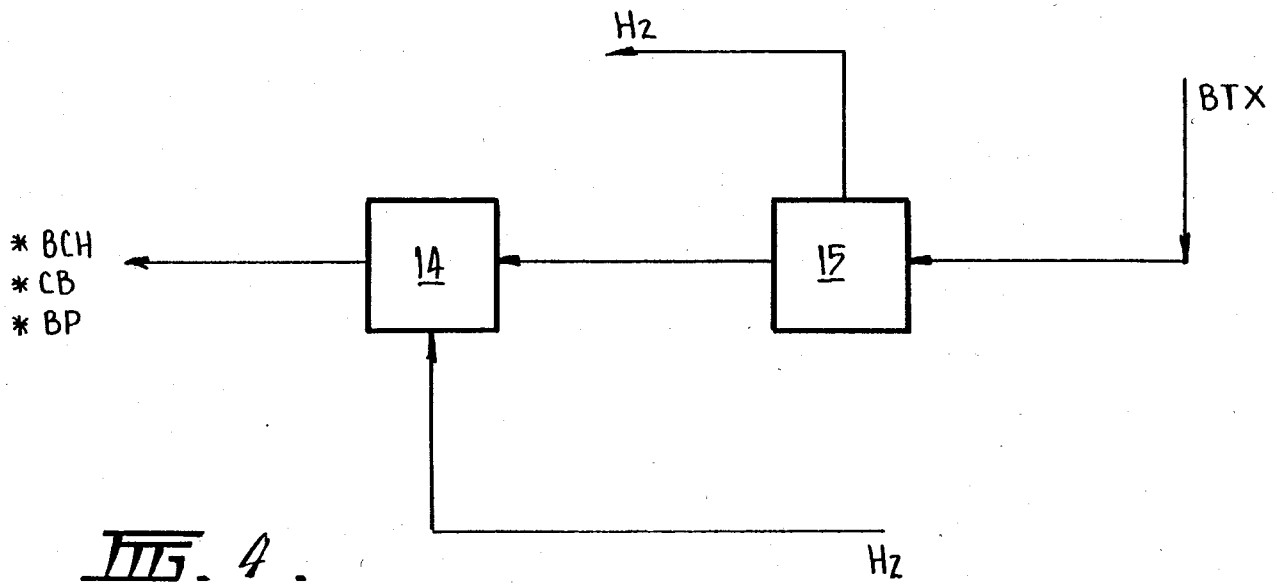

One embodiment of a method in accordance with the second aspect of the present invention will now be described by way of example only with reference to the accompanying drawings, in which:

FIG. 1 is a simplified flow diagram of a prior proposal for the refining of Syncrude by single stage hydrotreating to jet and diesel fuels by Sullivan et al, FIG. 2 is a simplified flow diagram of a prior proposal for the refining of Syncrude by hydrotreating and hydrocracking to all gasoline by Sullivan et al, FIG. 3 is a simplified flow diagram of the embodiment of the method in accordance with the second aspect of the present invention, and FIG. 4 shows the part of FIG. 3 in dashed lines modified to illustrate a second process for treating the BTX fraction of the reforming product.

As indicated hereinbefore "Syncrude" is a highly aromatic heavy oil which could be obtained from coal hydrogenation, coal pyrolysis, coal gasification tar, heavy shale oil or other carbonaceous feedstock processes.

In FIG. 3, the following codes have the meanings assigned to them below:

HIN=hydrindane
IN=indan
n-PCH=n-propylcyclohexane
n-BCH=n-butylcyclohexane
BCH=bicyclohexyl
CB=cyclohexylbenzene
BP=biphenyl
BTX=benzene, toluene and xylene
DEC=decalins
*=blending components for jet and diesel fuels With further reference now to FIG. 3, the syncrude is subjected to hydrotreating in a hydrotreating unit 8 to reduce sulphur, nitrogen and oxygen levels (preferably to less than several ppm in order to avoid poisoning of catalysts in subsequent treatments) and to effect stabilization of reactive components. Typical conditions in the hydrotreater 8 to provide effectively an all gasoline mode product would be temperatures of 390°–420° C. (preferred 400° C.), pressures of 12–20 MPa (preferred 17 MPa), with liquid hourly space velocities of 1 to 1.5 (preferably 1.0). Hydrogen recycle rates would be 1200–2500 STD $LH_2$ per L of feed, with 1500 $LH_2$/L liquid feed preferred. The catalyst may be a combination of oxides of nickel and/or cobalt together with tungsten and/or molybdenum oxides on an alumina support. The catalyst is sulphided appropriately by methods known to those skilled in the art, prior to being used.

Some kerosene and distillate fraction may be separated, for example by distillation in a distillation column 9, from the product of hydrotreater 8 and ultimately may be blended into the jet and diesel fuel. The extent to which these fractions are close to the required fuel specification and the extent to which different proportions of compounds I-IX of Table 2 are provided will determine the amount of kerosene and distillate which can be removed from the product of hydrotreater 8.

The product from the hydrotreater 8 and any bottoms from distillation column 9 are combined with liquids produced from a recycle hydrocracker 11 and enter a main distillation column 10. Here the light gases are removed and a light naphtha cut consisting of components with a boiling point not greater than about 65° C. is taken off as a gasoline blendstock. The distillation column may have offtakes for n-propylcyclohexane, n-butylcyclohexane, indan, hydrindane and decalins. The remaining light fraction, usually not exceeding a boiling point of between 180°–190° C. is sent on to a reformer 12. While it is assumed that this distillation is effected in one column it is not intended to preclude the use of multiple distillation columns or even other appropriate methods of separation. However distillation is the preferred method.

The non-distilled components from main distillation column 10 and recycled hydrocarbons comprising essentially indan but maybe also some hydrindane are combined and treated in the recycle hydrocracker 4 to increase the yield of substituted cyclohexanes and hydrindane. Typically the hydrocracker 11 will operate at pressures of 8–10 MPa, liquid hourly space velocities of 1.1 to 1.7 (preferably about 1.5) and temperatures in the range 290°–380° C. (with about 320° C. preferred). Recycle hydrogen rates may be about 900–1100 $LH_2$ STP/L liquid feed. The catalyst may contain similar combinations of metals to the one used in the hydrotreater 8, except in this case the support may be a silica/alumina matrix. The catalyst may also be pretreated as described with reference to hydrotreater 8. Alternatively the catalyst may contain a noble metal as described in the work of Sullivan et al, in which case the support could be a zeolite rather than an amorphous silica/alumina or a mixture of both as described by Yan (T-y. Yan "Zeolite-Based Catalysts for Hydrocracking" Ind. Eng. Chem. Process Des. Dev. 22 page 154, 1983). The liquid product of this unit is returned to the main distillation column 10.

The reformer 12 receives the heavy naphtha from the main distillation column 10 and treats it in the following manner. Typically it may operate at between 0.5–3.0 MPa (preferably 2 MPa), temperatures between 470°–520° C. (preferably 480° C.), liquid hourly space velocities in the range of 2 to 5 (preferably 3.5) and a molar hydrogen to feed ratio in the range of 3 to 5 (preferably 4.5). The catalyst may consist of platinum, typically 0.6%, or platinum and rhenium (typically 0.3%/0.3%) with chloride 0.3–0.6% on an alumina support. The product is a BTX rich liquid which could be combined with the light naphtha separated from the column 10 to produce a motor gasoline blendstock.

Alternatively in accordance with the second aspect of the present invention all or part of the BTX is converted to non-fused double ring compounds as exemplified by compounds VII to IX of Table 2. The following description of a typical process for this conversion does not imply restrictions on how this conversion may be effected. By way of example, typical process components of U.S. Pat. No. 4,093,671 are invoked. A hydroalkylation reactor 13 may operate at temperatures of between 100°–250° C. (preferably 170° C.) liquid hourly space velocities of 5–25 (preferably 10) pressures of 1.4 to 6.9 MPa (preferably 3.5 MPa) and a molar hydrogen to liquid feed rate of 0.2 to 1.0 (preferably 0.4). The catalyst used in the reactor 13 may consist of a platinum compound supported on a calcined, acidic nickel and rare-earth treated crystalline zeolite selected from the group consisting of Type X and Type Y zeolite.

In this hydroalkylation process approximately 10–15% of the BTX may be converted with 90% selectivity to $C_{12}$ compounds of the type described here as compounds VII to IX in Table 2. The lighter fractions which will include uncoverted BTX may be readily removed by distillation. Some BTX aromatics are likely to be converted to naphthenes and for present purposes a portion of this light fraction may be returned to the reformer 12 for the recovery of hydrogen and the recovery of the BTX. It will be clear to those skilled in the art that considerable scope exists for optimising the reformer-hydroalkylation combination of processes.

Having produced a material rich in compounds VII to IX it may be necessary to increase the amount of bicyclohexyl (VII) or reduce the amount of biphenyl (IX). This can be readily carried out in a hydrogenation unit 14. Without being restricted to a particular process, by way of example only, the use is proposed of a cobalt molybdenum catalyst on a Y alumina support, temperatures in the range 300°–375° C., a molar hydrogen to feed ratio of 0.1 to 0.17 and liquid hourly space velocities of about 10. (A. V. Sapre and B. C. Gates "Hydrogenation of Biphenyl Catalysed by Sulfided $CoO-MoO_3/Y-Al_2O_3$. The Reaction Kinetics" Industrial Engineering Chemistry Process Design and Development 21 page 86 1982).

With reference to FIG. 4 an alternative manner of converting the BTX fraction to the non-fused double ring compounds exemplified by compounds VII to IX of Table 2 is by way of pyrolysis at 15 when the fraction is passed through a red hot iron tube, bubbled through molten lead or pumice or passed at elevated temperatures over vanadium compounds, as indicated hereinbefore. Such pyrolysis process releases hydrogen which may conveniently be used in the hydrogenation unit 14 should the product of the pyrolysis require modifying to provide more bicyclohexyl or less biphenyl as previously described in relation to FIG. 3.

Thus access is now available to all the compounds of the type I to IX in Table 2, and it is possible to proceed to blend these components, including as desired the mildly hydrotreated straight run kerosene and distillate, to produce desirable fuels including specification grade jet fuel and diesel.

It has been proposed that some processes for coal liquefaction produce a naphtha-like liquid in almost one step as a final product. One example is the process for converting coal (and other carbonaceous materials) by employing a molten metal halide reaction environment as proposed in, for example, U.S. Pat. Nos. 4,134,826 and 4,247,385. These naphthas consist primarily of aromatics and naphthenes. Thus, as part of the present invention and as a variation of the process described with reference to FIG. 3 such naphthas can enter the overall novel process at distillation column 10 and result in the production not only of gasoline but also jet fuel and diesels.

The following Examples are given to illustrate specific steps in preparation of some of the constituents of Table 2.

EXAMPLE 1

A sample of anthracene oil, a coke-oven by-product, having a nominal boiling range of 250°–350° C. was used as a representative of coal derived liquids. Those familiar with the technology of coal liquefaction will be aware of the fact that anthracene oils are frequently used to mimic the properties of a whole range of coal derived liquids.

The anthracene oil was hydrogenated in a packed bed reactor at a liquid hourly space velocity of 1.2 and hydrogen to liquid rate of 1500 L $H_2$ STP/L liquid feed. A temperature of 420° C. and a pressure of 24 MPa were employed in the presence of a presulphided $CoO-MoO_3$ on alumina catalyst. A naphtha fraction with an upper boiling limit of 180° C. was distilled off in order to minimise decalin carryover. The naphtha represented 8% by weight of the single pass hydrotreated oil and the kerosene fraction was 27% and contained 1% decalins and 15% tetralin. On recycle to the hydrocracker the tetralins will be converted to decalins. The composition of the naphtha is shown in Table 3 and was determined by gas-liquid chromatography using techniques well known to those skilled in the art. A sample of the liquid was separated into thirty narrow boiling range cuts using a spinning band still and the presence of the compounds of interest was confirmed by gas chromatography-mass spectroscopy.

TABLE 3

MAJOR COMPONENTS IN COAL DERIVED NAPHTHA FROM HYDROGENATED ANTHRACENE OIL

| Compound Naphthenes | Weight % | Compound Aromatics | Weight % |
|---|---|---|---|
| Cyclohexane | 5.49 | Benzene | 0.74 |
| Methyl Cyclohexane | 2.63 | Toluene | 3.56 |
| Ethyl Cyclohexane | 11.17 | Xylenes | 3.64 |
| n-Propyl Cyclohexane | 16.71 | Ethyl Benzene | 4.69 |
| Hydrindane | 6.42 | Ethyl Toluenes | 7.78 |
| n-Butyl Cyclohexane | 1.23 | Indan | 17.34 |
| Methyl Ethyl Cyclohexanes | 3.81 | | 37.75% |
| | 47.46% | | |

Remaining compounds, 14.79% consist of 3.9% unidentified (probably, nirogen, oxygen and sulphur compounds), 1.91% paraffins and the remainder being naphthenes and aromatics.

The n-propyl and n-butyl cyclohexane amount to 18% of the naphtha and the indan and hydrindane amount to nearly 24% of the naphtha. This gives a potential yield of approximately 42% of n-propyl and n-butyl cyclohexane from the naphtha. Benzene and substituted benzenes acceptable as BTX components amount to approximately 18%.

EXAMPLE 2

The naphtha fraction from example 1 was subjected to catalytic reforming without removing any of the constituents. The conditions of reforming were 480° C. 3 MPa, a liquid hourly space velocity of 4.8 and a molar hydrogen to liquid ratio of 4.5. The catalyst contained 0.3% Pt and 0.6% Cl supported on alumina pellets.

The reformate was analysed by gas liquid chromatography and the results are shown in Table 4. The proportion of BTX components has increased to 33% of the naphtha excluding indan, n-propyl benzene and n-butyl benzene.

TABLE 4

(Major Components in Reformate of Naphtha)

| Compound Naphthenes | Weight % | Compound Aromatics | Weight % |
|---|---|---|---|
| Most predominant naphthene, hydrindane, at 1.03% | | Benzene | 5.76 |
| | | Toluene | 6.28 |
| | | Ethyl Benzene | 14.69 |
| | | Xylenes | 5.25 |
| | | n-Propyl Benzene | 18.45 |
| | | Ethyl Toluenes | 14.01 |
| | | Indan | 17.77 |
| | | n-Butyl Benzene | 1.80 |
| Total: | 6.22% | | 84.01% |

Remaining compounds, 9.8% consists of 3.9% unidentified (as for Table 3), about 2.5% paraffins and the remainder aromatics.

From Examples 1 and 2 it may be appreciated that the naphtha has yielded in excess of 70% of components which could be destined for jet fuel and diesel components.

EXAMPLE 3

A selection of components from Table 2 were blended into two synthetic mixtures designated K1 and D1 as shown in Table 5. The kerosene simulation K1, contains 50% monosubstituted cyclohexanes with the remainder of the compounds, including some nuclear bridged bicyclic compounds, selected so as to ensure that the final mixture would have a boiling curve acceptable for the Jet A1 specification. The diesel simulation contains 50% nuclear bridged bicyclic compounds with the remaining compounds, including some mono substituted cyclohexanes, selected to be acceptable to the diesel specification ASTM D975/ID. As can be seen, the compound selection was fairly arbitary within the scope of the invention, but neither mixture contains any paraffins.

Both K1 and D1 were subjected to a range of standard petroleum industry tests and the results are shown in Table 6.

Some observations are worth noting. Firstly even though the composition ranges chosen have been arbitary many of the commercial specifications are readily met. The two exceptions are the smoke point and freezing point of the kerosene K1. Whilst the density specification is slightly out, density is no longer regarded as a critical specification for jet fuels (see N. R. Sefer and C. A. Moses "Crude Sources and Refining Trends and Their Impact on Future Jet Fuel Properties". SAE Technical Paper 811056, Aerospace Congress and Exposition, Annaheim, Calif., Oct. 5-8, 1981). The diesel has eluded the freezing point and kinematic viscosity by a marginal amount. The diesel has peculiar freezing behaviour in that crystals form at −10° C., the cloud point, but do not appear to remelt at the same temperature but at a somewhat higher temperature. Since the standard specifies that one chooses the higher of the freezing termperature and the remelting temperature as the effective freezing point, the latter specification is not met for this mixture. However the behaviour of the mixture suggests that the freezing point could be readily modified by improvers which would lead to the formation of smaller crystals that would remelt more readily at a lower temperature.

From the information available for the diesel sample D1, the cetane number was estimated to be about 20 using the standard Cetane Index (D976/66) and the Diesel Index (IP21/53) which have been proposed for petroleum based diesel fuels and as will be seen are not applicable to diesel fuels in accordance with the first aspect of the invention. The cetane number was actually measured using the following test procedure.

The test was performed by running an indirectinjection single-cyclinder diesel engine (KUBOTA ER-40N1) on the given fuel, combustion air being drawn through a 25L steel tank. The tank inlet valve is closed and the pressure of the combustion air in the inlet manifold is recorded at the point when the engine first misfires. The higher the cetane number, the lower the recorded pressure, for example, fuels of 60 cetane number will continue to run the engine down to a pressure of only ⅓ of an atmosphere before misfire occurs.

The test procedure is calibrated with reference fuels of known cetane number, as measured by a cetane engine in accordance with ASTM D613. The above test is a recognized method of cetane number estimation embodied in the IP41/A standard.

The diesel reported a cetane value of 43 which is well above the minimum standard requirement of 40 although two short of the generally accepted value of 45. What is remarkable about this value is that high quality diesels from essentially paraffinic stocks (i.e. not in accordance with the invention) cease to be effective as diesels when the aromatic level exceeds 30%. Yet remarkably, without any paraffins, D1 may contain up to 21% aromatics, and performs quite well in cetane response and remain within the standard even though this would not be expected from the traditional guidelines such as Cetane Index and Diesel Index. The kerosene K1 reported a cetane number of 53 and would clearly perform exceptionally well for volatile diesel applcations such as in car-diesel situations.

EXAMPLE 4

Sample K1 was reformulated in the same appropriate proportions but with 12% tetralin instead of 20% producing Sample K2 as shown in Table 5. The new kerosene K2 had a smoke point of 24 mm as shown in Table 7 and since no naphthalenes are present, K2 readily meets the smoke point specification. Clearly without paraffins present one would not have expected to achieve this result with 12% aromatics and as noted previously 3-4% aromatics is generally the highest level expected to be tolerable in a low paraffinic jet fuel.

EXAMPLE 5

The mixture K3 was prepared as shown in Table 5 and submitted for specification testing to Jet A1. As set out in Table 7 it achieved a smoke point of 23 mm and because of the absence of naphthalenes this mixture will meet the smoke specification. The freezing point on cooling was −40° C. but on reheating the crystals did not disappear until the temperature was raised to −30° C. This mixture just falls short of the freezing point specification.

EXAMPLE 6

Two distillate blends D2 and D3 were prepared as shown in Table 5. D2 is predominantly bicyclohexyl. As indicated in Table 7 the "downward" freezing was −3° C. and the upward freezing point was −1° C. It was thus able to meet the freezing point specification. The measured flash point was 80° C. and viscosity was 2.9 CSt thus making it an acceptable diesel fuel. D3 is a mixture containing essentially 12% aromatics. The "downward" and "upward" freezing points were found to be −15° C. and −10° C. respectively. Flash point was 60° C. and the viscosity at 1.9 CSt is just on the specification borderline. Using the method described in relation to diesel fuel D1 the cetane number for D3 was 50.5 and was estimated to be 45+ for D2.

EXAMPLE 7

To achieve the freezing point specification for jet fuel, mixture K4 was prepared as shown in Table 5. As shown in Table 7 whilst this mixture became hazy at −30° C. substantial freezing did not occur until less than −80° C. The mixture would have been readily pumpable at −50° C.

TABLE 5

| | SYNTHETIC MIXTURES | | | | | | |
|---|---|---|---|---|---|---|---|
| | PERCENTAGE BY VOLUME | | | | | | |
| COMPONENT | K1 | K2 | K3 | K4 | D1 | D2 | D3 |
| n-Propylcyclohexane | 25.1 | 27 | 28 | — | 9.9 | — | 12 |

TABLE 5-continued

| SYNTHETIC MIXTURES | | | | | | | |
|---|---|---|---|---|---|---|---|
| | PERCENTAGE BY VOLUME | | | | | | |
| COMPONENT | K1 | K2 | K3 | K4 | D1 | D2 | D3 |
| n-Butylcyclohexane | 24.9 | 29 | 42 | 60 | 14.7 | 5 | 13 |
| Decalin | 19.9 | 22 | 13 | 20 | 19.7 | 5 | 23 |
| Tetralin | 20.2 | 12 | 12 | 5 | 5.0 | — | 6 |
| Benzenecyclohexyl | — | — | — | — | 4.9 | — | — |
| Bicyclohexyl | 9.9 | 11 | 5 | 15 | 34.7 | 90 | 40 |
| Biphenyl | — | — | — | — | 11.1 | — | 6 |

TABLE 6

| TEST RESULTS ON SYNTHETIC MIXTURES | | | | | | |
|---|---|---|---|---|---|---|
| | | | "JET FUEL" K1 | | "DIESEL FUEL" D1 | |
| TEST | STANDARD | UNIT | Specified | Observed | Specified | Observed |
| Density | D4052-81 | gm $L^{-1}$ 20° C. | 0.775–0.830 | 0.8638 | | 0.8890 |
| Smoke point | IP 57/55 | mm | 25 min[a] | 17 | na | na |
| Flash point | D3243 or D56 DIN51755 | °C. | 38 min | 42 | 38 min 55(DIN51601) | 60 |
| Cloud point | | °C. | | | 1 max | −10 |
| Freezing point | IP16/73 | °C. | −50° max | −30 | −3 + 3 max | 5 |
| Aniline point | D611-77 | °C. | | | | 28.3 |
| Kinematic viscosity | D445-79 | cSt at 40° C. | | | 1.9–4.1 (D975) | 1.81 |

[a]20 mm min if napthalenes less than 3% (vol).

TABLE 7

| TEST RESULTS ON SYNTHETIC MIXTURES | | | | | |
|---|---|---|---|---|---|
| TEST Standards, units and specification | "JET FUEL", OBSERVED | | | "DIESEL FUEL", OBSERVED | |
| is as in Table 6 | K2 | K3 | K4 | D2 | D3 |
| Density | — | — | — | — | — |
| Smoke point | 24 | 23 | — | — | — |
| Flash point | 49 | — | — | 80 | 60 |
| Freezing point (crystals) | −45 | −40 | −80 | −20 | −15 |
| Freezing point (clear) | −25 | −30 | −30 | 0 | −10 |
| Cetane number | na | na | na | 45+ | 50.5 |
| Kinematic viscosity | na | na | na | 2.9 | 1.9 |

The first aspect of the present invention, namely the discovery that a new route for preparing fuels and particularly jet and diesel fuels may be achieved by blending substituted mono cyclohexanes with two ring non-fused cycloalkanes has been described with reference to the Examples by way of compositions which do not necessarily meet the fuel specifications hitherto specified. Nevertheless, it is considered that these compositions will meet other fuel specifications. Similarly, in view of the advantageous properties of the main components of the fuels, other less advantageous constituents may be retained in the new blend, which in previously proposed routes would have to be eliminated or substantially eliminated. Thus up to for example 10% w/w of the new fuel may comprise two or more fused ring compounds. Although biphenyl has a cetane number that is too low for diesel fuel use, up to at least 10% w/w may be included in the fuel. The desired proportions in the fuels will also be a function of the weather in the location at which they will be used. Thus a diesel fuel for use in Canada may encounter less high temperatures than one for use in Africa and therefore need not be so stringent on vapourisation characteristics.

I claim:

1. A method of producing a fuel comprising:

hydroprocessing fused polynuclear aromatic compounds to produce a product rich in mononuclear cycloalkanes and mononuclear aromatics comprising a kerosene fraction, a distillate fraction, light gases, light naphtha having a boiling point less than about 65° C., indan, hydrindan, decalin, n-propylcylohexane, n-butylcyclohexane and a naphtha fraction having a boiling range of about 180°–190° C.;

converting at least a portion of said product rich in mononuclear cycloalkanes and mononuclear aromatics into two-ring, non-fused cycloalkane compounds; and mixing said two-ring non-fused cycloalkanes with at least one alkylated cycloalkane.

2. The method according to claim 1, wherein said mononuclear cycloalkane compounds include a six-carbon ring.

3. The method according to claim 1, wherein said hydroprocessing step includes hydrotreating and hydrocracking said fused polynuclear aromatic compounds.

4. The method according to claim 1 wherein said kerosene and distillate fractions are separated from said product of said hydroprocessing step prior to said conversion step.

5. The method according to claim 1 wherein at least one member of the group consisting of light gases, light naphtha having a boiling point less than about 65° C., n-propylcyclohexane, n-butylcyclohexane, indan, hydrindan and decalin is separated from said product of said hydroprocessing step prior to said conversion step.

6. The method according to claim 5, wherein said at least one member is separated from said product of said hydroprocessing step by distillation.

7. The method according to claim 1, wherein said naphtha fraction having a boiling range of about 180°–190° C. is reformed to produce a BTX-rich liquid product and at least a portion of said BTX-rich liquid product is converted to said two-ring non-fused cycloalkanes.

8. The method according to claim 7, wherein said at least a portion of said BTX-rich liquid product is converted to said two-ring non-fused cycloalkane by hydroalkylation.

9. The method according to claim 8, wherein said hydroalkylation is followed by hydrogenation to increase the yield of two-ring non-fused cycloalkane compounds.

10. The method according to claim 7, wherein said at least a portion of said BTX-rich liquid product is converted to said two-ring non-fused cycloalkane by pyrolysis.

11. The method according to claim 10, wherein said pyrolysis is followed by hydrogenation to increase the yield of two-ring non-fused cycloalkane compounds.

12. The method according to claim 1, wherein said alkylated cycloalkane comprises a n-propylcyclohexane or n-butylcyclohexane.

13. The method according to claim 1, wherein said two-ring non-fused cycloalkane comprises nuclear-substituted bicyclohexyl.

14. The method according to claim 13, wherein said two-ring non-fused cycloalkane further comprises nuclear-substituted cyclohexylbenzene.

15. The method according to claim 1, further comprising mixing up to about 10% biphenyl with said mixture of said two-ring non-fused cycloalkane and said at least one alkylated cycloalkane.

16. The method according to claim 1, further comprising mixing at least one member selected from the group consisting of hydrindane, decaline and tetralin with said mixture of said two-ring non-fused cycloalkane and said at least one alkylated cycloalkane.

17. The method according to claim 1, wherein said mixture of said two-ring non-fused cycloalkane and said at least one alkylated cycloalkane has a smoke point greater than 20 mm and a freezing point less than minus 30° C.

18. The method according to claim 1, wherein said mixture of said two-ring non-fused cycloalkane and said at least one alkylated cycloalkane has a cetane number greater than 40 and a freezing point less than 5° C.

* * * * *